US008926557B2

(12) United States Patent
Yeager

(10) Patent No.: US 8,926,557 B2
(45) Date of Patent: Jan. 6, 2015

(54) FLUID DISPENSER WITH TONGUE DEPRESSOR

(71) Applicant: Amcor Limited, Hawthorn (AU)

(72) Inventor: Don F. Yeager, Milville, NJ (US)

(73) Assignee: Amcor Limited, Hawthorn (AU)

( * ) Notice: Subject to any disclaimer, the term of this patent is extended or adjusted under 35 U.S.C. 154(b) by 0 days.

(21) Appl. No.: 13/674,407

(22) Filed: Nov. 12, 2012

(65) Prior Publication Data

US 2013/0123690 A1 May 16, 2013

Related U.S. Application Data

(60) Provisional application No. 61/560,127, filed on Nov. 15, 2011.

(51) Int. Cl.

| | |
|---|---|
| ***A61J 7/00*** | (2006.01) |
| ***A61J 1/06*** | (2006.01) |
| *A61J 1/14* | (2006.01) |

(52) U.S. Cl.

CPC ..... *A61J 7/0061* (2013.01); *A61J 1/067* (2013.01); *A61J 2001/1418* (2013.01); *A61J 2200/76* (2013.01)

USPC ..... 604/77

(58) Field of Classification Search

USPC ..... 604/77

See application file for complete search history.

(56) References Cited

U.S. PATENT DOCUMENTS

| | | | | | |
|---|---|---|---|---|---|
| 374,122 | A | * | 11/1887 | Genese | 600/240 |
| 990,277 | A | * | 4/1911 | Lauderdale | 433/89 |
| 2,673,563 | A | * | 3/1954 | Kwast | 604/77 |
| 4,880,409 | A | * | 11/1989 | Bergkvist et al. | 604/73 |
| 5,037,388 | A | * | 8/1991 | Stock | 604/57 |
| 5,318,523 | A | * | 6/1994 | Lu | 604/77 |
| 5,507,278 | A | * | 4/1996 | Karell | 128/200.23 |
| 5,692,493 | A | * | 12/1997 | Weinstein et al. | 128/200.23 |
| 2013/0123690 | A1 | * | 5/2013 | Yeager | 604/77 |

* cited by examiner

*Primary Examiner* — Nicholas Lucchesi
*Assistant Examiner* — Diva K Chander
(74) *Attorney, Agent, or Firm* — Harness, Dickey & Pierce, P.L.C.

(57) ABSTRACT

A fluid dispenser contains a fluid and selectively delivers the fluid orally to a subject. The fluid dispenser includes a main body defining a vessel that contains the fluid. The fluid dispenser also includes a dispensing portion that extends from the main body. The dispensing portion defines a passage therethrough that is in fluid communication with the vessel. The passage terminates at a dispenser opening through which the fluid exits the passage and flows into the mouth of the subject. Moreover, the fluid dispenser includes a tongue depressor that extends from the dispensing portion. The tongue depressor is operable to depress the tongue of the subject while the fluid is dispensed into the mouth of the subject.

17 Claims, 7 Drawing Sheets

FLUID DISPENSER WITH TONGUE DEPRESSOR

CROSS REFERENCE TO RELATED APPLICATION

This application claims the benefit of U.S. Provisional Application No. 61/560,127, filed on Nov. 15, 2011. The entire disclosure of the above application is incorporated herein by reference.

FIELD

This disclosure generally relates to a fluid dispenser and, more particularly, relates to a fluid dispenser with a tongue depressor.

BACKGROUND

This section provides background information related to the present disclosure which is not necessarily prior art.

Self-contained fluid dispensers have been proposed that facilitate delivery of a fluid to a subject. For instance, medicine, liquid vitamins, or other fluid can be contained within the dispenser, and the fluid can be delivered from an open end into the mouth of a patient. However, an uncooperative patient (e.g., a small child, a dog or other animal, etc.) can resist delivery of the fluid, for instance, by biting down on the dispenser and pinching off the flow of the fluid. Accordingly, delivery of the fluid can be difficult, especially to uncooperative patients.

SUMMARY

This section provides a general summary of the disclosure, and is not a comprehensive disclosure of its full scope or all of its features.

A fluid dispenser that contains a fluid and selectively delivers the fluid orally to a subject is disclosed. The fluid dispenser includes a main body defining a vessel that contains the fluid. The fluid dispenser also includes a dispensing portion that extends from the main body. The dispensing portion defines a passage therethrough that is in fluid communication with the vessel. The passage terminates at a dispenser opening through which the fluid exits the passage and flows into the mouth of the subject. Moreover, the fluid dispenser includes a tongue depressor that extends from the dispensing portion. The tongue depressor is operable to depress the tongue of the subject while the fluid is dispensed into the mouth of the subject. A method of manufacturing the fluid dispenser is also disclosed.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
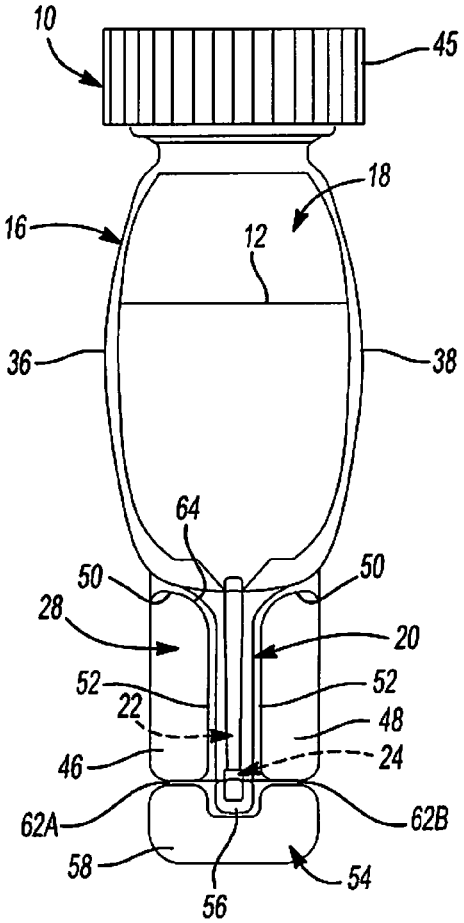
FIG. 1 is a plan view of a fluid dispenser with a tongue depressor according to various exemplary embodiments of the present disclosure.

Example embodiments will now be described more fully with reference to the accompanying drawings.

Referring initially to FIGS. 1-8, a fluid dispenser 10 is illustrated according to exemplary embodiments of the present disclosure. It will be appreciated that the fluid dispenser 10 of the present disclosure can depart from the embodiments illustrated without departing from the scope of the present disclosure.

As will be discussed, the dispenser 10 can contain a fluid 12 and selectively deliver the fluid 12 orally to a subject 14 (patient, etc.). The fluid dispenser 10 can generally include a main body 16 defining a vessel 18 that contains the fluid 12. The fluid dispenser 10 can also generally include a dispensing portion 20 that extends from the main body 16. The dispensing portion 20 can define a passage 22 extending therethrough. The passage 22 can be in fluid communication with the vessel 18, and the passage 22 can terminate at a dispenser opening 24 (FIGS. 1 and 8) through which the fluid 12 can exit the passage 22 and flow into a mouth 26 (FIG. 2) of the subject 14. Additionally, the dispenser 10 can include a tongue depressor 28 that extends from the dispensing portion 20 and that is thin and flat. The tongue depressor 28 can be used to depress the tongue 30 (FIG. 2) of the subject 14 while the fluid 12 is dispensed into the mouth 26 of the subject 14. Also, the thickness and rigidity of the tongue depressor 28 can inhibit one's ability to bite down and impede the flow of fluid 12 through the passage 22. As such, the fluid 12 is very likely to be dispensed as intended to the subject 14.

Figure 2:
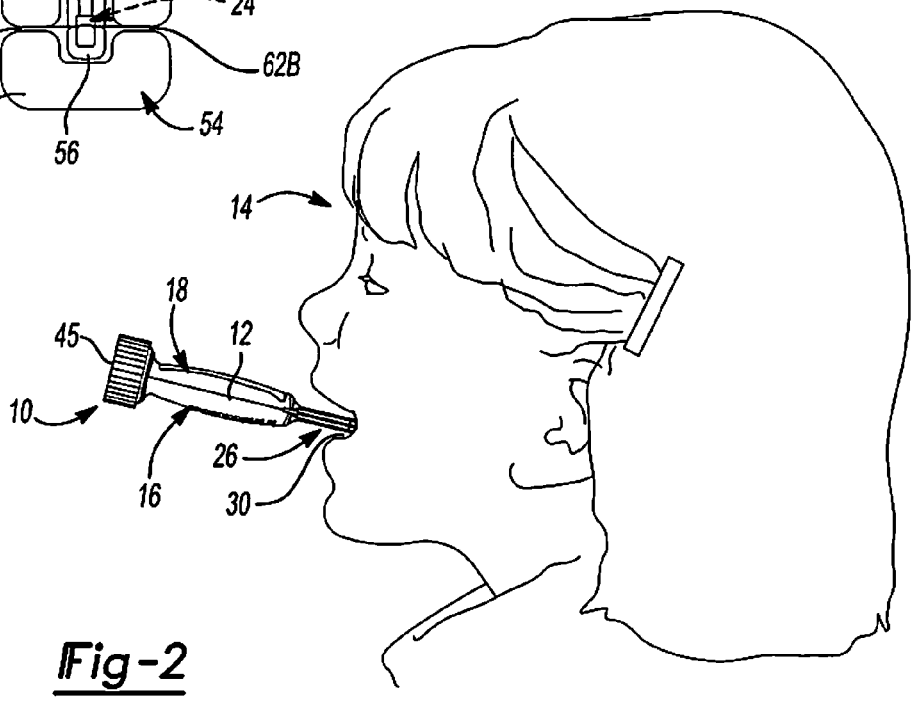
FIG. 2 is a side view of the fluid dispenser of FIG. 1 shown while delivering fluid to a subject.

Although the subject 14 shown in FIG. 2 is a child, it will be appreciated that the subject 14 could be an infant, a toddler, an older human, a dog, a cat, or any other non-human. Also, the fluid 12 can be of any type, such as a medicinal liquid, liquid vitamins, etc. There can be any suitable amount of the fluid 12 inside the dispenser 10 (e.g., 5 cc, 10 cc, etc.). For instance, the amount can be a single dose of the fluid 12 (e.g., in an amount adapted for delivery to a single subject 14 in a single use).

Figure 3:
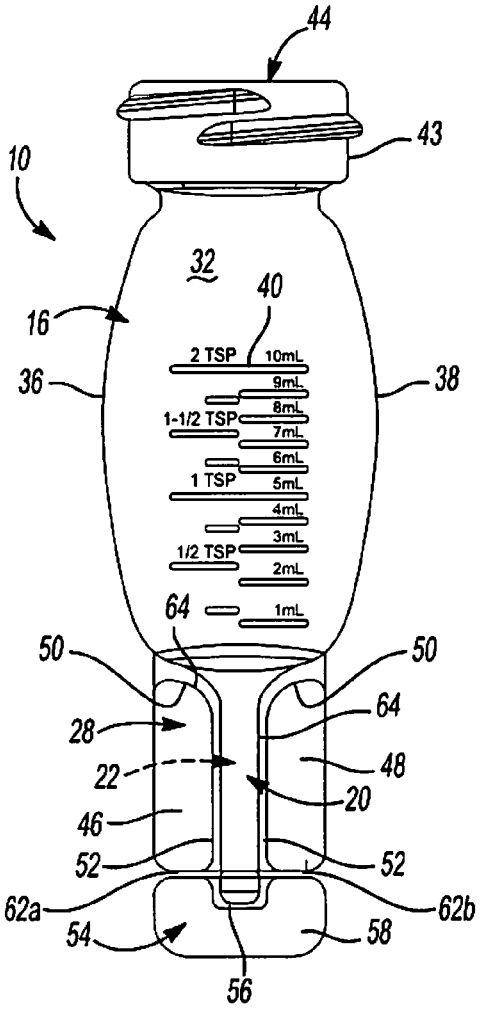
FIG. 3 is a plan view of the fluid dispenser of FIG. 1.
Figure 4:
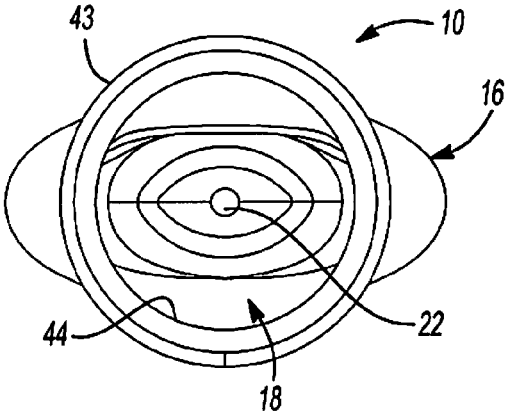
FIG. 4 is a top view of the fluid dispenser of FIG. 3.
Figure 5:
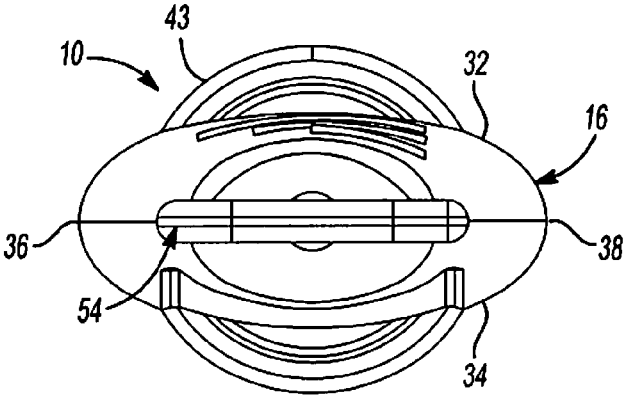
FIG. 5 is a bottom view of fluid dispenser of FIG. 3.

Various features of the dispenser 10 will now be discussed in greater detail. For instance, the main body 16 can include a front wall 32 and a back wall 34 that are spaced apart with the vessel 18 defined therebetween (FIG. 5). The front and back walls 32, 34 can be joined at a first edge 36 and a second edge 38. The edges 36, 38 can be curved longitudinally, as shown in FIG. 3. Also, in some embodiments, the edges 36, 38 can be substantially straight along the longitudinal axis of the dispenser 10. One or both of the front and back walls 32, 34 can be resiliently flexible and compressible toward the other for pushing the fluid 12 out of the vessel 18 as will be discussed. The front and back walls 32, 34 can be shaped and joined together such that the main body 16 appears somewhat flattened (oval-shaped) in cross section. This can facilitate holding and squeezing of the main body 16. Also, the front and back walls 32, 34 can have surface roughness or other features that make the main body 16 easier to hold and squeeze.

Figure 6:
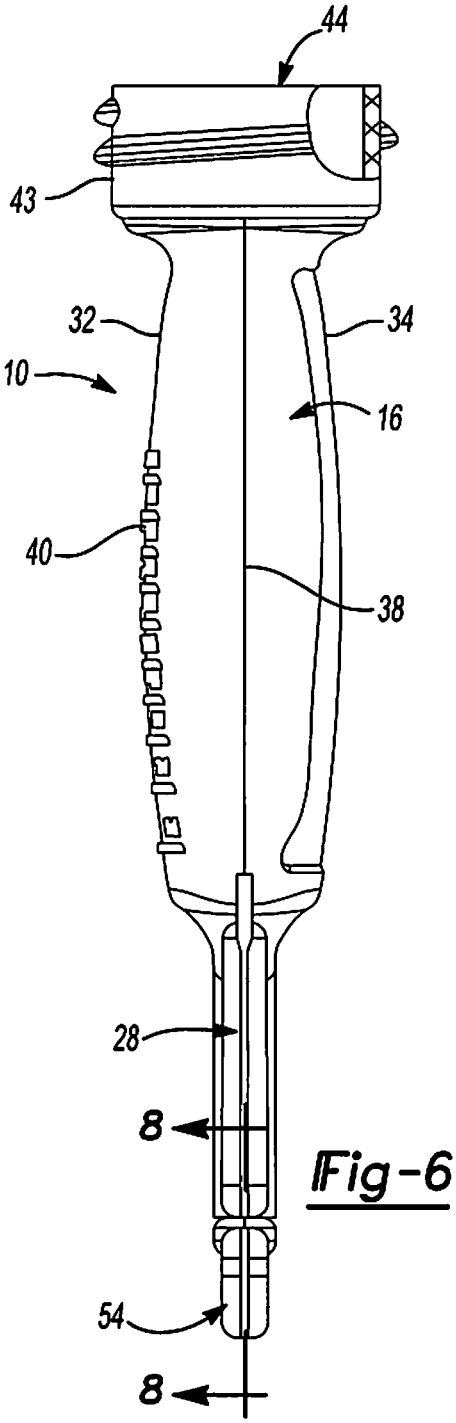
FIG. 6 is a side view of the fluid dispenser of FIG. 3.
Figure 7:
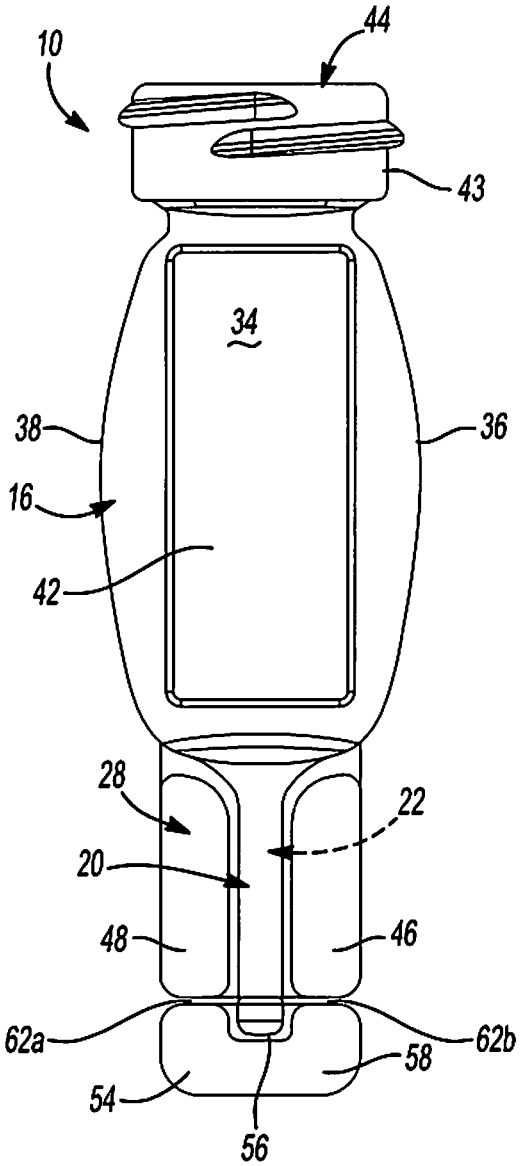
FIG. 7 is a reverse plan view of the fluid dispenser of FIG. 3.

As shown in FIG. 3, the main body 16 can also include one or more gradations 40 for measuring an amount of the fluid 12 within the fluid dispenser 10. In the embodiments illustrated, gradations 40 are included on the front wall 32 of the main body 16. Also, as shown in FIGS. 6 and 7, the main body 16 can include a panel 42 on the back wall 34. The panel 42 can be rectangular and can be used for attaching a separate label, for printing a label thereon, etc. Furthermore, in some embodiments, the main body 16 can include information that has been embossed or otherwise applied thereto. The information on the dispenser 10 can include an expiration date of the fluid 12, a lot code, etc. Furthermore, the information can be included on any suitable area of the dispenser 10.

The main body 16 can further include a main opening 44 (FIGS. 3, 4, 6, and 7) that provides fluid access into the vessel 18. For instance, a cylindrical tube 43 can extend longitudinally from the front and rear walls 32, 34 of the main body 16, and the main opening 44 can be defined within the tube 43. The main opening 44 can be substantially circular in shape. Also, the tube 43 and the main opening 44 can be substantially centered longitudinally on the dispenser 10.

Additionally, the dispenser 10 can include a closure 45 (FIGS. 1 and 2) that is removably attached to the tube 43. In some embodiments, the closure 45 can be threadably attached to the tube 43; however, the closure 45 could be heat sealed (sonic welded), or secured in another way. Additionally, the main body 16 can be sealed closed instead of including a separate closure 45. Also, in some embodiments, there is no main opening 44, and the dispenser opening 24 is the only access into or out of the dispenser 10.

The dispensing portion 20 can be elongate and axially straight. The dispensing portion 20 can extend distally from the main body 16, on an end opposite that of the tube 43. The passage 22 be can tapered adjacent the vessel 18, but the passage 22 can have a substantially constant width along the rest of its length. The passage 22 can have a substantially circular cross section taken through its longitudinal axis. Also, the dispensing portion 20 and the passage 22 can be substantially centered longitudinally on the dispenser 10.

Furthermore, the tongue depressor 28 can include a first portion 46 and a second portion 48 that are symmetrical to each other and that flank the dispensing portion 20. In some embodiments, the first and second portions 46, 48 of the tongue depressor 28 are hollow (see FIG. 8) and are sealed about the respective periphery. Each of the first and second portions 46, 48 can include a proximal edge 50 that is attached to the main body 16 and a medial edge 52 that is attached to the dispensing portion 20. The medial edge 52 can extend along substantially an entire length of the dispensing portion 20. The first edge 36 and the second edge 38 of the main body 16 can contour outward away from the proximal edge 50 of the tongue depressor 28. The first and second portions 46, 48 can be elongate, relatively thin, and substantially flat. As such, the tongue depressor 28 can extend into the mouth 26 of the subject 14 to depress the tongue 30 such that the subject 14 is unlikely to impede flow of the fluid 12 out of the dispenser 10.

Figure 8:
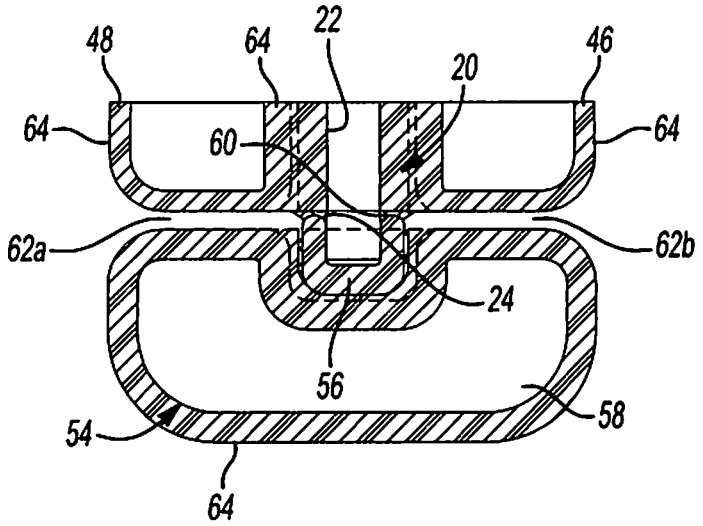
FIG. 8 is a section view of the fluid dispenser taken along the line 8-8 of FIG. 6.

The dispenser 10 can further include a removable closure 54 (e.g., a removable tab) that substantially seals the dispenser opening 24. The closure 54 can include a central portion 56 and a U-shaped flange 58 that extends about the central portion 56. As shown in FIG. 8, the central portion 56 can be cup-shaped and the flange 58 can be substantially flat. In some embodiments, the first and second portions 46, 48 of the tongue depressor 28 are hollow, as shown partially in FIG. 8. Lateral portions of the flange 58 can be shaped similarly to and substantially aligned with the first and second portions 46, 48 of the tongue depressor 28. Also, one or more slits 62*a*, 62*b* (FIGS. 1, 3, 7, and 8) can separate the flange 58 from the first and second portions 46, 48 of the tongue depressor 28.

As shown in FIG. 8, the central portion 56 can be removably attached to the dispensing portion 20, adjacent the dispenser opening 24, via a frangible coupling 60 (i.e., tear-away tab, break-away tab, fracturable joint, etc.). The frangible coupling 60 (and/or other features of the dispenser 10) can be included according to the teachings of U.S. Pat. No. 5,897,009, issued to O'Meara on Apr. 27, 1999 and/or U.S. Pat. No. D534,648, issued to Zahn et al. on Jan. 2, 2007, the disclosures of which are included herein by reference in their entirety. As shown in FIG. 8, the coupling 60 can be a small ring of relatively thin material that attaches the central portion 56 to the dispensing portion 20. In additional embodiments, the removable closure 54 can be removably attached to the main body 16 (e.g., by a threaded attachment, etc.).

The coupling 60 and the central portion 56 can substantially seal the dispenser opening 24 when attached to the dispensing portion 20. However, the dispenser opening 24 can be unsealed, for instance, by grasping the flange 58 and twisting or bending the closure 54 relative to the dispensing portion 20. This motion can fracture the coupling 60 such that the closure 54 can be removed from the dispensing portion 20 to unseal the dispenser opening 24.

It will be appreciated that the closure 45 could be attached in other ways. For instance, the closure 45 can be threadably, adhesively, or otherwise attached to the dispensing portion 20 without departing from the scope of the present disclosure.

In some embodiments, a manufacturer, pharmacist, or other upstream user of the dispenser 10 can fill the dispenser 10 by removing the closure 45, introducing the fluid 12 into the vessel 18 through the main opening 44, and securing the closure 45 to the main body 16 to substantially seal the fluid 12 therein. Then, the dispenser 10 can be sold or otherwise distributed as a disposable, one-time-use dispenser 10. Once the closure 54 has been removed, the user can insert and extend the dispensing portion 20 into the mouth 26 of the subject 14 and depress the tongue 30 using the tongue depressor 28 while squeezing the front and back walls 32, 34 of the main body 16 toward each other. This allows the fluid 12 to flow from the vessel 18, through the passage 22, out of the dispenser opening 24, and into the mouth 26 to be swallowed by the subject 14. Because the tongue 30 is depressed during this process, the subject 14 is unlikely to close their mouth 26, bite down on the dispensing portion 20, or otherwise impede flow of the fluid 12 into the mouth 26.

Once the fluid 12 has been emptied from the dispenser 10, the dispenser 10 can be discarded. Thus, the dispenser 10 can be a disposable, single-dose dispenser. As such, the amount of fluid 12 within the dispenser 10 can be controlled by the manufacturer, and overdosing is unlikely. In additional embodiments, after the fluid 12 has been fully emptied from the dispenser 10, the user can remove the closure 45 to clean and refill fluid 10 in the vessel 18 such that the dispenser 10 can be used again for distributing doses of the fluid 12.

The dispenser 10 can be made from a substantially rigid material, such as rigid plastic. The front and back walls 32, 34 can have certain areas that are thinner than others to allow the front and back walls 32, 34 to be resiliently compressed. Furthermore, the dispenser 10 can be manufactured via molding processes. In some embodiments, the dispenser 10 can be molded from multiple sheets of material that are joined at the edges 36, 38 and at internal welds 64 (FIG. 8) so as to define the vessel 18, the passage 22, and the hollow interiors of the first and second portions 46, 48 of the tongue depressor 28 and flange 58. In some embodiments, the main body 16, the dispensing portion 20, the tongue depressor 28, and the closure 54 can be integrally connected so as to be monolithic. Accordingly, the dispenser 10 can be manufactured efficiently, repeatably, and accurately.

Figure 9:
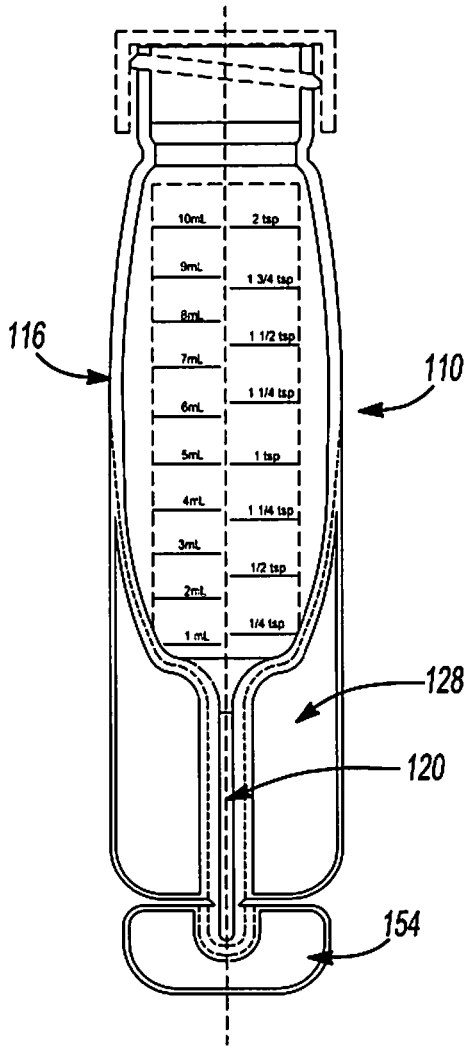
FIG. 9 is a plan view of the fluid dispenser according to additional embodiments of the present disclosure.

Referring now to FIG. 9, the fluid dispenser 110 is illustrated according to additional exemplary embodiments. Components of the dispenser 110 that correspond to those of the embodiments of FIGS. 1-8 are indicated with corresponding reference numbers increased by 100.

As shown, the fluid dispenser 110 can include a main body 116, a dispensing portion 120, a tongue depressor 128, and a closure 154 that are substantially similar to those of the embodiments of FIGS. 1-8. However, these components are shaped and dimensioned slightly differently. For instance, the tongue depressor 128 can be substantially equally as wide as the main body 116.

Figure 10:
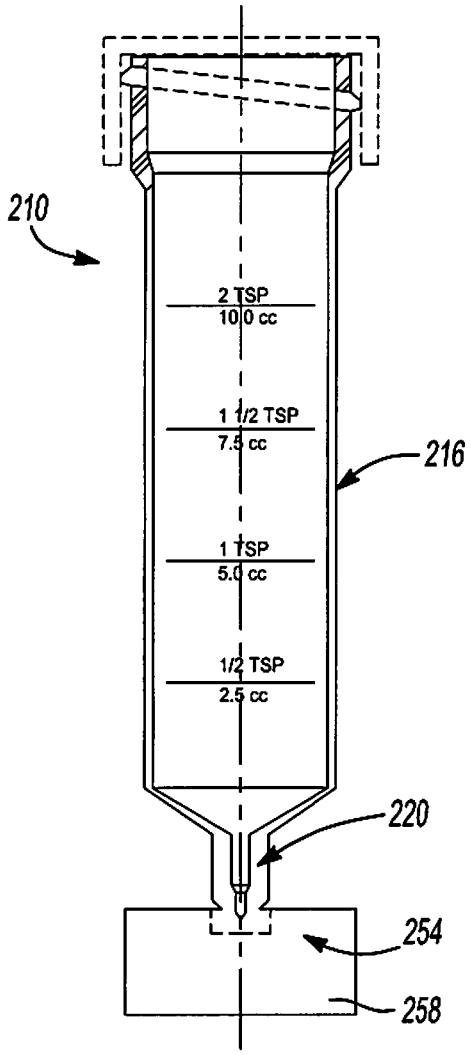
FIG. 10 is a plan view of the fluid dispenser according to additional embodiments of the present disclosure.

Referring now to FIG. 10, the fluid dispenser 210 is illustrated according to additional exemplary embodiments. Components of the dispenser 210 that correspond to those of the embodiments of FIGS. 1-8 are indicated with corresponding reference numbers increased by 200.

As shown, the fluid dispenser 210 can include a main body 216, a dispensing portion 220, and a closure 254. The flange 258 of the closure 254 extends further outward in the radial direction as compared with the embodiments of FIGS. 1-9. Also, the dispensing portion 220 is shorter than those of the embodiments of FIGS. 1-9.

Figure 11:
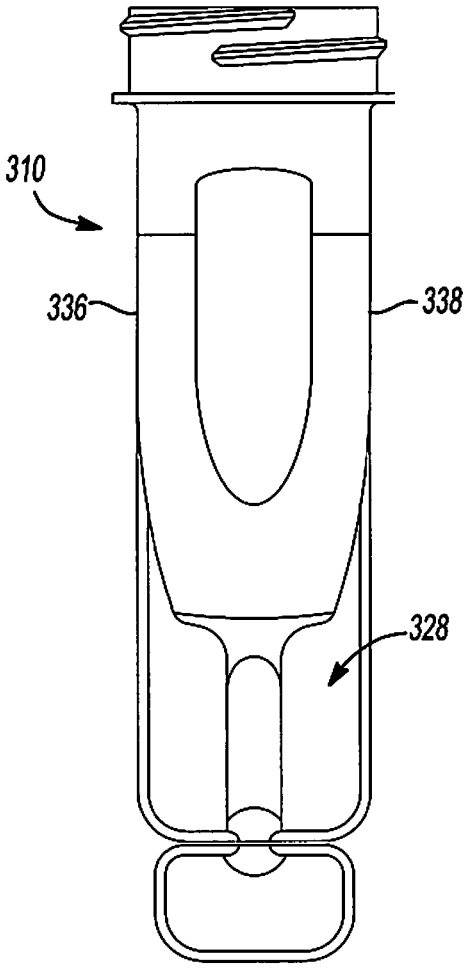
FIG. 11 is a plan view of the fluid dispenser according to additional embodiments of the present disclosure.
Figure 12:
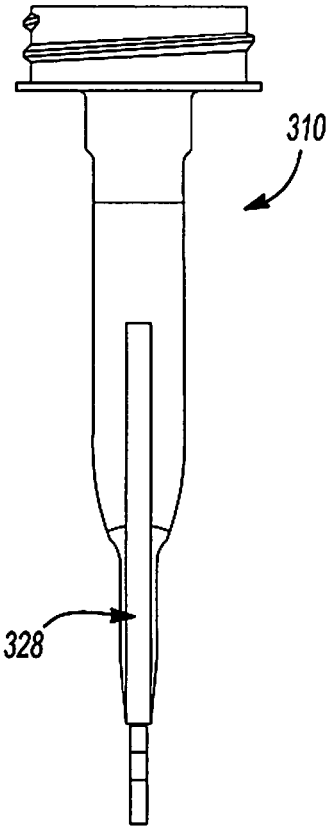
FIG. 12 is a side view of the fluid dispenser of FIG. 11.
Figure 13:
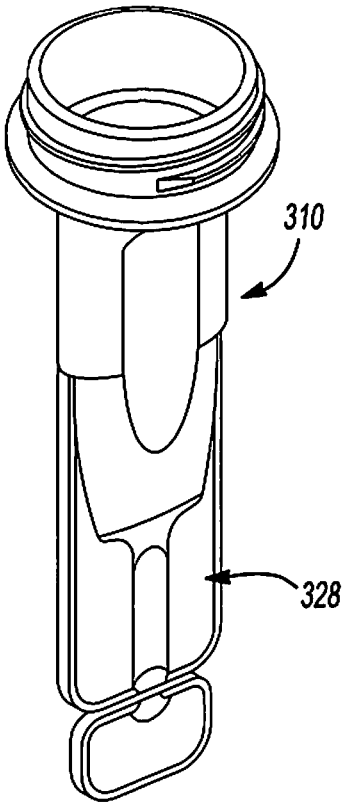
FIG. 13 is a perspective view of the fluid dispenser of FIG. 11.
Figure 14:
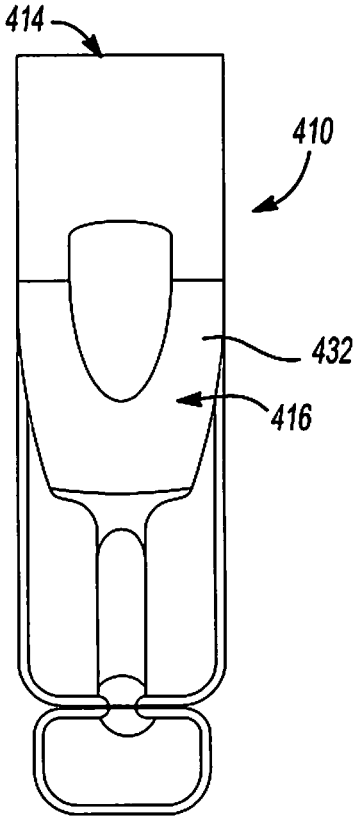
FIG. 14 is a plan view of the fluid dispenser according to additional embodiments.
Figure 15:
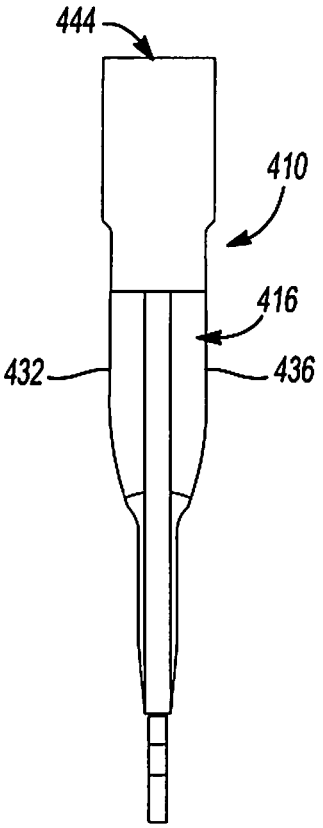
FIG. 15 is a side view of the fluid dispenser of FIG. 14.
Figure 16:
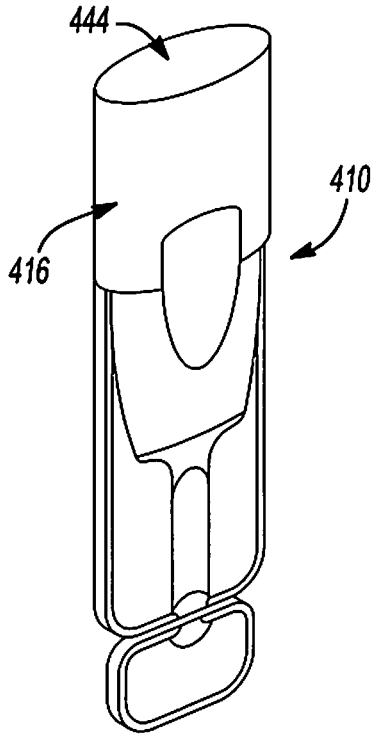
FIG. 16 is a perspective view of the fluid dispenser of FIG. 14.

Referring now to FIGS. 11-13, the fluid dispenser 310 is illustrated according to additional exemplary embodiments. Components of the dispenser 310 that correspond to those of the embodiments of FIGS. 1-8 are indicated with corresponding reference numbers increased by 300.

The shape of the fluid dispenser 310 can be substantially similar to one or more of the embodiments discussed above. However, the edges 336, 338 can be substantially straight and parallel to the longitudinal axis. Also, the edges 336, 338 can smoothly transition into the tongue depressor 328 (i.e., the width of the tongue depressor 328 can be approximately equal to the distance between the edges 336, 338).

Referring now to FIGS. 14-17, the fluid dispenser 410 is illustrated according to additional exemplary embodiments. Components of the dispenser 410 that correspond to those of the embodiments of FIGS. 1-8 are indicated with corresponding reference numbers increased by 400.

Figure 17:
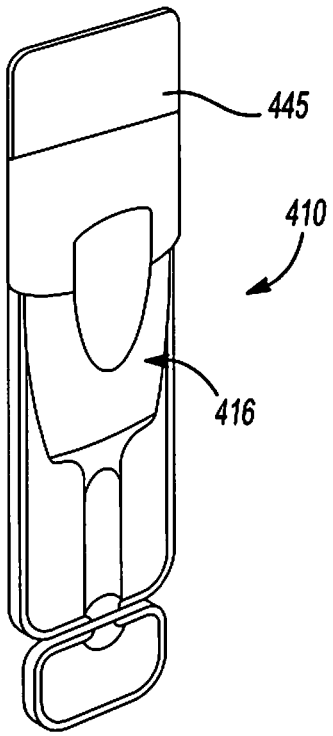
FIG. 17 is a perspective view of the fluid dispenser of FIG. 14, wherein the dispenser has been heat sealed.

The fluid dispenser 410 can be substantially similar to the embodiments of FIGS. 11-13. However, the main body 416 can terminate at an ovate (oval-shaped) opening 444 (see FIG. 16). As shown in FIG. 17, once the fluid 412 is inside the dispenser 410, the opening 444 can be sealed shut at a heat seal 445. Stated differently, the front and back walls 432, 434 can be sealed together to create the heat seal 445. Also, as shown in FIG. 17, lot code, expiration date, or other information can be included (e.g., embossed) on the heat seal 445.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A fluid dispenser that contains a fluid and selectively delivers the fluid orally to a subject, the subject including a mouth and a tongue, the fluid dispenser comprising:

a main body defining a vessel that contains the fluid, the main body is flexible and configured such that compressing the main body provides the vessel with a reduced volume and pushes fluid out from within the vessel;

a dispensing portion that extends from the main body, the dispensing portion defining a passage therethrough that is in fluid communication with the vessel, the passage terminating at a dispenser opening through which the fluid exits the passage and flows into the mouth of the subject;

a removable closure attached to the dispenser opening with a frangible coupling to seal the dispenser opening, removal of the closure from the dispenser opening by breaking the frangible coupling permits fluid to exit the dispenser opening for single dose dispensing; and a tongue depressor that extends from the dispensing portion, the tongue depressor being operable to depress the tongue of the subject while the fluid is dispensed into the mouth of the subject;

wherein the main body, the dispensing portion, and the tongue depressor are made of a like material and integrally connected so as to be monolithic.

2. The fluid dispenser of claim 1, wherein the tongue depressor includes a first portion and a second portion that flank the dispensing portion.

3. The fluid dispenser of claim 2, wherein the first portion and the second portion each include a proximal edge that is attached to the main body and a medial edge that is attached to the dispensing portion.

4. The fluid dispenser of claim 2, wherein the first portion and the second portion are hollow.

5. The fluid dispenser of claim 1, wherein the main body includes a plurality of gradations for measuring an amount of the fluid within the fluid dispenser.

6. The fluid dispenser of claim 1, wherein the main body defines a main opening into the vessel and a closure that is removably attached to the main body, the closure operable to substantially seal the main opening.

7. The fluid dispenser of claim 6, wherein the closure is threadably attached to the main body.

8. The fluid dispenser of claim 1, wherein the main body includes at least one resiliently flexible wall, the resiliently flexible wall operable to be resiliently flexed to push the fluid from the vessel.

9. The fluid dispenser of claim 8, wherein the main body includes a front wall and a back wall that are spaced apart with the vessel defined therebetween, the front wall and the back wall each being resiliently compressible toward the other to push the fluid from the vessel.

10. The fluid dispenser of claim 1, wherein the removable closure includes a central portion and a flange that is attached to the central portion, the central portion being attached to the dispensing portion via the frangible coupling, the flange being aligned with the tongue depressor, a slit separating the flange from the tongue depressor.

11. The fluid dispenser of claim 1, wherein the main body is disposable and contains a single dose of the fluid.

12. A method of manufacturing a fluid dispenser that contains a fluid and selectively delivers the fluid orally to a subject, the subject including a mouth and a tongue, the method comprising:

forming the fluid dispenser of a single material to be monolithic and to have:

a main body defining a vessel that is operable to contain the fluid, the main body formed to be flexible and configured such that compressing the main body provides the vessel with a reduced volume and pushes fluid out from within the vessel;

a dispensing portion that extends from the main body, the dispensing portion defining a passage therethrough that is in fluid communication with the vessel, the passage terminating at a dispenser opening;

a removable closure attached to the dispenser opening with a frangible coupling to seal the dispenser opening, removal of the closure from the dispenser opening by breaking the frangible coupling permits fluid to exit the dispenser opening for single dose dispensing; and a tongue depressor that extends from the dispensing portion, the tongue depressor being operable to depress the tongue of the subject while the fluid is dispensed into the mouth of the subject.

13. A fluid dispenser configured to contain a fluid and selectively deliver the fluid orally to a subject having a mouth and a tongue, the fluid dispenser comprising:

a main body defining a vessel configured to store the fluid therein;

a tube extending from a first end of the vessel, the tube defining a main opening through which the fluid can be loaded into the vessel, a coupling portion is proximate to the main opening and is configured to cooperate with a cap to close the main opening;

a dispensing portion extending linearly from the main body and the vessel in alignment with an axial center of the main opening at a second end of the vessel that is opposite to the first end, the dispensing portion defining a passage therethrough that is in fluid communication with the vessel, the passage terminating at a dispensing opening through which the fluid exits the passage and flows into the mouth of the subject, the dispensing portion does not substantially extend into the vessel and terminates prior to reaching a mid-portion of the vessel between the first and second ends of the vessel;

a removable closure attached to the dispenser opening with a frangible coupling to seal the dispenser opening, removal of the closure from the dispenser opening by breaking the frangible coupling permits fluid to exit the dispenser opening for single dose dispensing; and a tongue depressor extending from the main body and from opposite sides of the dispensing portion to the removable closure, the tongue depressor operable to depress the tongue of the subject while the fluid is dispensed into the mouth of the subject;

wherein the main body, the dispensing portion, and the tongue depressor are made of a like material and integrally connected so as to be monolithic.

14. The fluid dispenser of claim 13, wherein the coupling portion includes threads extending from the tube, and the tube is cylindrical.

15. The fluid dispenser of claim 13, wherein the dispensing portion extends further from the main body than the tongue depressor does.

16. The fluid dispenser of claim 13, wherein the removable closure is a removable tab.

17. The fluid dispenser of claim 13, wherein the removable closure and the tongue depressor define a slit therebetween.

* * * * *